US006286163B1

(12) United States Patent
Trimble

(10) Patent No.: US 6,286,163 B1
(45) **Date of Patent: *Sep. 11, 2001**

(54) FITTED SHEET CONSTRUCTION

(76) Inventor: Lynn Trimble, 17772 Bridle La., Jupiter, FL (US) 33478

( * ) Notice: Subject to any disclaimer, the term of this patent is extended or adjusted under 35 U.S.C. 154(b) by 0 days.

This patent is subject to a terminal disclaimer.

(21) Appl. No.: 09/667,085

(22) Filed: Sep. 21, 2000

(51) Int. Cl.[7] ..... A47G 9/02
(52) U.S. Cl. ..... 5/485; 5/496; 5/497; 5/499
(58) Field of Search ..... 5/485, 496, 497, 5/498, 499

(56) References Cited

U.S. PATENT DOCUMENTS 1,732,663 * 10/1929 Schimmel ..... 5/499
4,045,831 * 9/1977 Clark ..... 5/497
4,338,693 * 7/1982 Vitale ..... 5/497
4,488,323 12/1984 Colburn .
4,651,371 3/1987 Hahn .
5,491,853 * 2/1996 Turnbull ..... 5/497
5,996,147 * 12/1999 Trimble ..... 5/485
6,108,836 * 8/2000 Keene, III ..... 5/497

* cited by examiner

*Primary Examiner*—Michael F. Trettel
(74) *Attorney, Agent, or Firm*—McHale & Slavin

(57) ABSTRACT

A sheet construction adapted to fittingly engage a mattress includes a main panel having a first pouch at a first end of the panel and a second pouch at a second end of the panel. The first pouch is sized and shaped to encompass a first end of the mattress, while the second pouch is adapted to encompass a second end of the mattress. The first and second pouches include cooperating flaps that extend from the main panel and overlap. The pouches secures the sheet construction to the mattress. In an alternative embodiment, the pouches are sized and oriented to encompass the mattress sides.

5 Claims, 5 Drawing Sheets

FITTED SHEET CONSTRUCTION

RELATED APPLICATIONS

This application is by the same inventor of U.S. Pat. No. 5,996,147 issued Dec. 7, 1999, currently active, the contents of which are herein incorporated by reference.

FIELD OF THE INVENTION

This invention is directed to a bedding, and more particularly, to a bedsheet that fittingly engages a mattress with releasable fasteners.

BACKGROUND OF THE INVENTION

The conventional unfitted or flat bedsheet has long been used as the bottom sheet to cover a mattress. This kind of sheet is desirable because it will fit various mattresses, is easily cleaned, handled, and stored. However, these sheets require the lifting of the mattress to tuck the sheet under it and can easily work loose and become creased during normal movement of a sleeping person.

Contoured or fitted sheets overcome some of the problems associated with flat bedsheets by sewing an elastic strip around the bottom corners of the sheet to create pockets which fit around the four corners of the mattress. The sheet is tucked under the mattress for three corners than on the forth corner, the mattress is lifted up to allow the pocket of the sheet to be slipped over the corner of the mattress. Principle disadvantages of fitted sheets are they often wear out at the pockets, are bulky to store, wash, and handle.

The use of hook and loop fastening materials (such as VELCRO) on bedding and mattresses is well known. However, the strips are usually positioned at each corner or the sheet so that when the sheet is put over a mattress a pocket is formed in each of the four corners of the sheet. As a result, a large portion of the force exerted by a mattress on a tight fitting sheet is at the sheet's corners. The combination of shear, torque, and outwardly pulling tensile forces often causes the hook and loop fastening strips to pull loose. Further, the hook and loop strips can become attached to each other and other material making it difficult wash, handle, and store.

Accordingly, it would be highly desirable to provide an improved bedding in which the sheet doesn't work loose and become creased during use, the corners don't fray from use, and is easily washed, handled, and stored.

DESCRIPTION OF THE PRIOR ART

Conventional fitted sheets are disclosed, for example, in U.S. Pat. No. 3,181,179, which discloses fitted sheets having shoulders cut on each end and side panel which are subsequently sewn together and bordered with elastic strips. U.S. Pat. No. 3,694,832 discloses fitted sheets wherein triangular pieces of material are removed from the end and side panels, and the remaining material is folded and sewn to obtain the shaped or fitted corners.

U.S. Pat. No. 4,045,832 discloses a fitted sheet with overlapping flaps having releasable strips made of VELCRO. The corners are constructed with cutouts through which a portion of the mattress corner extends when the sheet is in use. U.S. Pat. No. 4,488,323 discloses a fitted sheet with velcro strips attached to the mattress and the sheet such that they can be removable attached.

U.S. Pat. No. 4,651,371 discloses a fitted sheet utilizing adjustable, releasable corner fasteners. The VELCRO strips are situated such that when the sheet is folded to accommodate the mattress corner, the strips attach.

SUMMARY OF THE INVENTION

The present invention is a sheet construction that engage a mattress securely. The sheet construction includes a main panel having mattress-encompassing pouches at opposite ends. One of the pouches is formed by two cooperating flaps that overlap and are detachably secured together. The pouches cooperatively secure the sheet construction to the mattress.

The flapped pouch aspect of the present invention makes the sheet easy to install. This feature also makes the sheet construction advantageously difficult to remove when the bed is occupied, yet promotes easy removal when the bed is empty. This prevents unwanted sheet removal and keeps bed occupants from being entangled in the sheet. The present invention is useful on both large and small beds, for children and adults.

Thus, an object of the present invention is to provide a sheet construction that is difficult to remove while a bed is occupied, but easy to install and remove when the bed is empty.

A further objective is to provide a sheet which is easy to wash, store, and handle.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Figure 1:
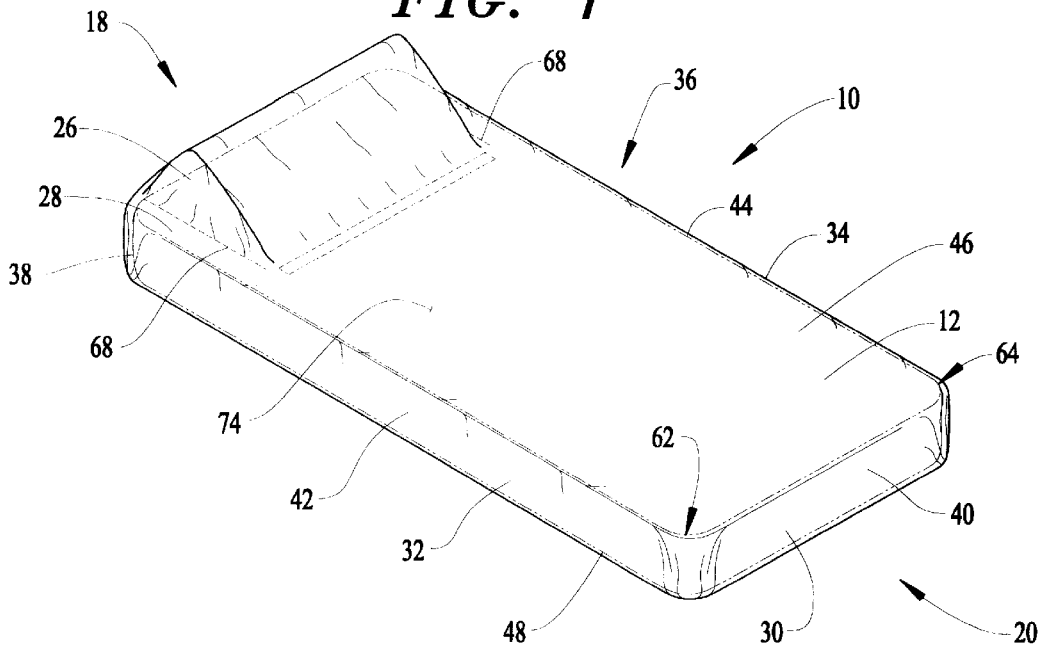
FIG. 1 is a pictorial view of the sheet construction of the present invention, shown in use on a mattress.
Figure 2:
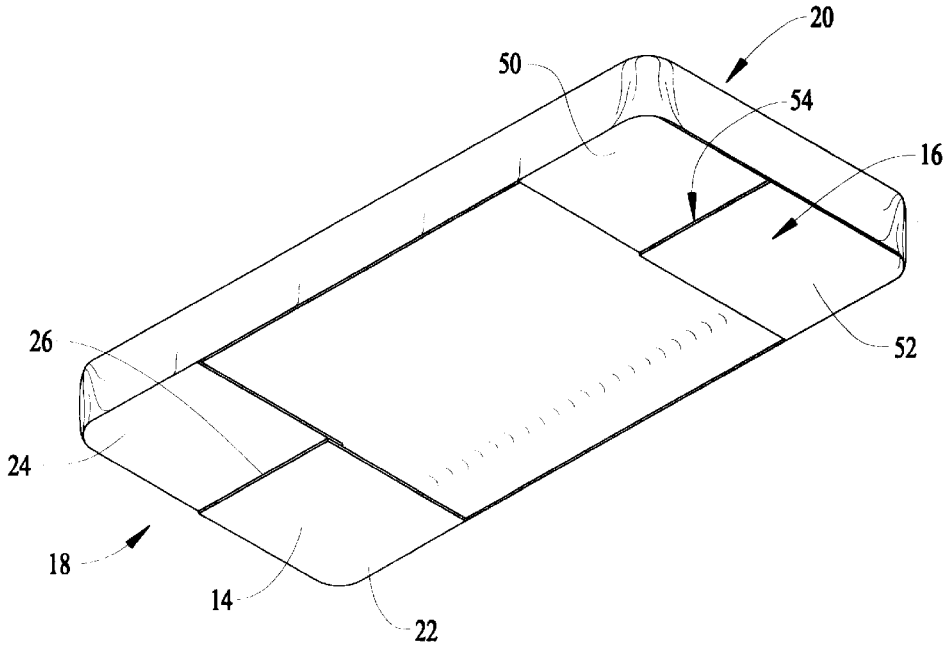
FIG. 2 is a bottom perspective view of the sheet construction shown in FIG. 1 with cooperating flaps in the overlapped position at both ends of the sheet construction.
Figure 2A:
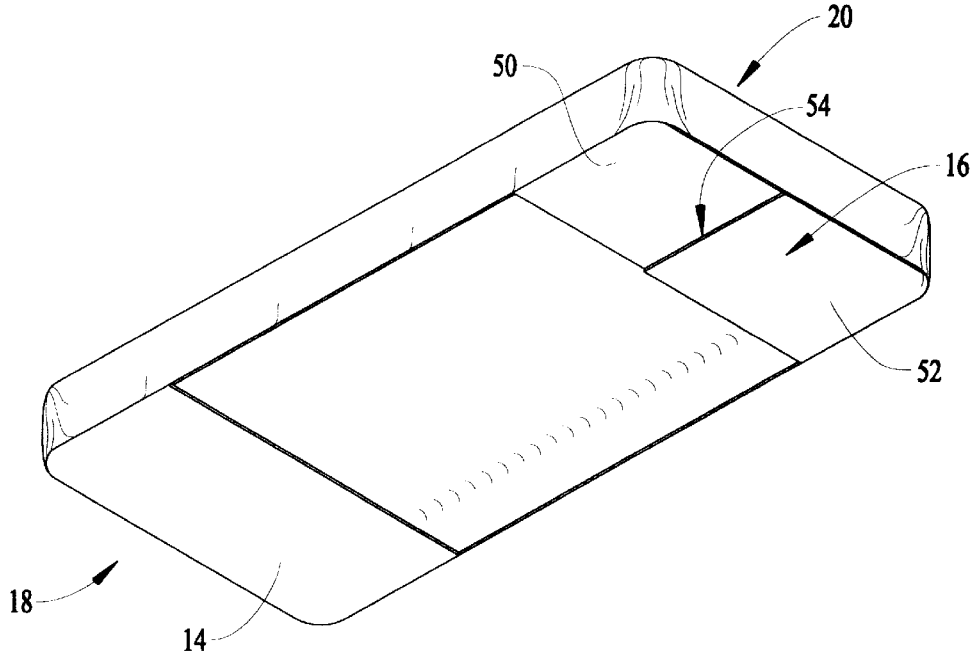
FIG. 2A is a bottom perspective view of the sheet construction shown in FIG. 1 with the auxiliary panel secured by a zipper.
Figure 2B:
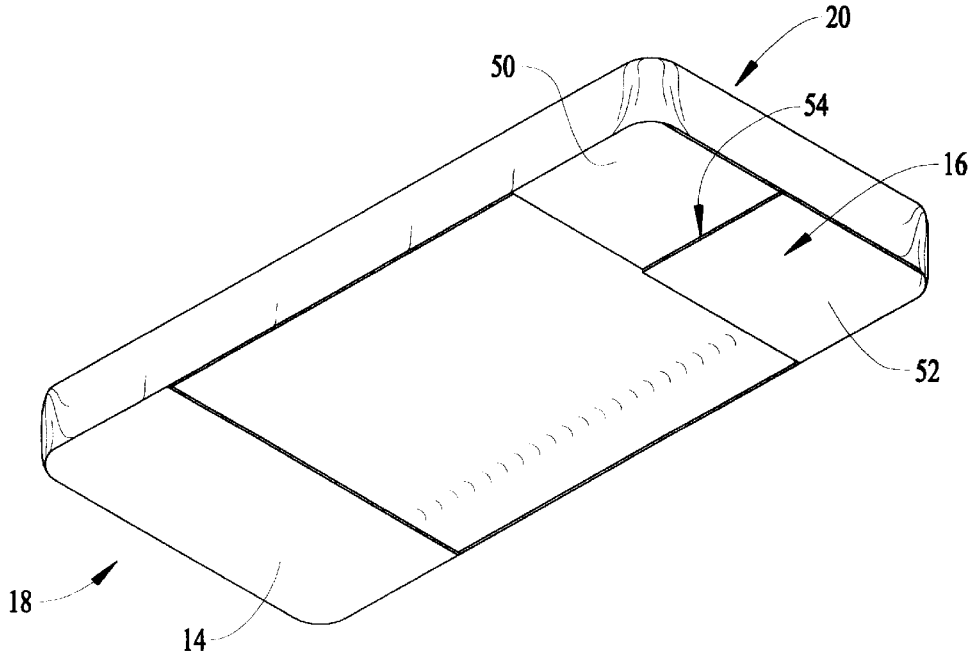
FIG. 2B is a bottom perspective view of the sheet construction shown in FIG. 1 with the auxiliary panel secured by buttons.
Figure 2C:
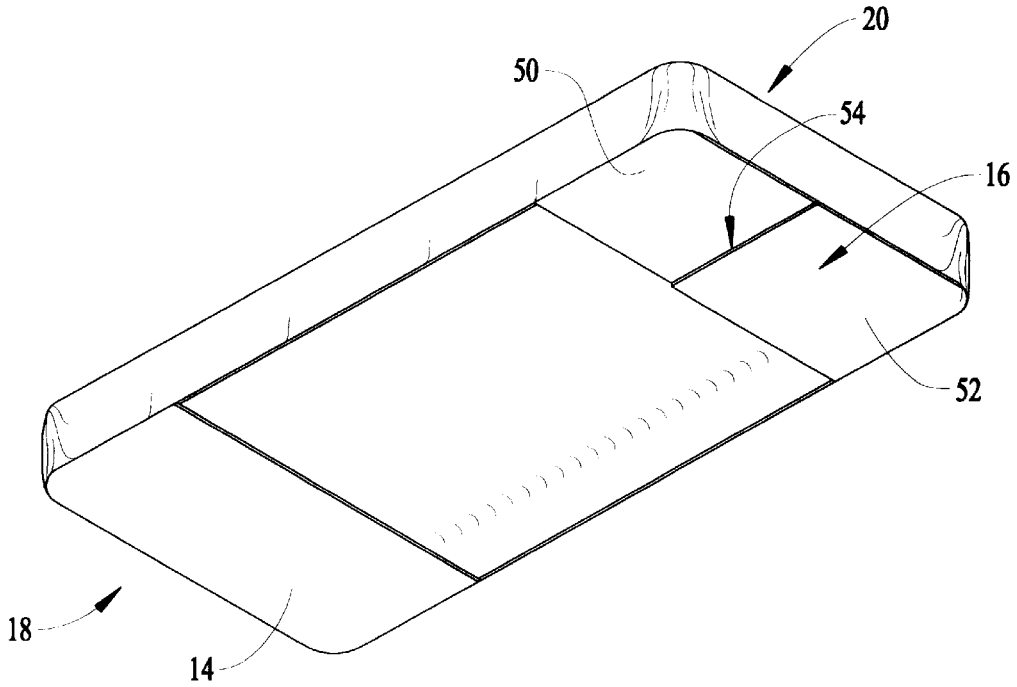

Now with reference to FIGS. 1 and 2, the sheet construction 10 of the present invention is shown. By way of overview, the sheet construction 10 includes a main panel 12 having pouches 14 and 16 located at opposite ends 18 and 20 thereof. The pouches 14 and 16 help secure the main panel to the mattress. The details of the sheet construction will now be discussed.

With additional reference to FIG. 2, the main panel 12 is substantially-rectangular piece of fabric having a first end 28 spaced apart from a second end 30. The main panel 12 is sized to fit a desired style of mattress, e.g. queen, king, twin, or baby crib. Each of the panel ends is characterized by a scoop-like pouch 14 and 16. Each pouch 14 and 16, acts as a receptacle into which a portion of a mattress 36 is fed. The pouches 14 and 16 may be formed integral with the main panel 12 or may be discrete items fastened to the main panel. Additionally, the pouches 14 and 16 may be elasticized if desired, to accommodate mattresses 36 of various size.

With continued reference for FIG. 1, the mattress 36 includes a first end 38, a second end 40, a first side 42, and second side 44. The mattress 36 is further characterized by a top face 46 and an opposite bottom face 48. During use, the sheet construction main panel 12 lies against the mattress top face 46.

The first and second pouches 14 and 16 are sized and positioned to encompass the mattress first and second ends, 38 and 40 respectively. In the preferred embodiment, only second pouch 16 is formed with a pair of cooperating flaps 50 and 52 that extend from the main panel 12. In an alternative embodiment, the first and second pouches 14 and 16 are formed with a pair of cooperating flaps 22 and 24 and 50 and 52 that extend from the main panel 12.

Figure 3A:
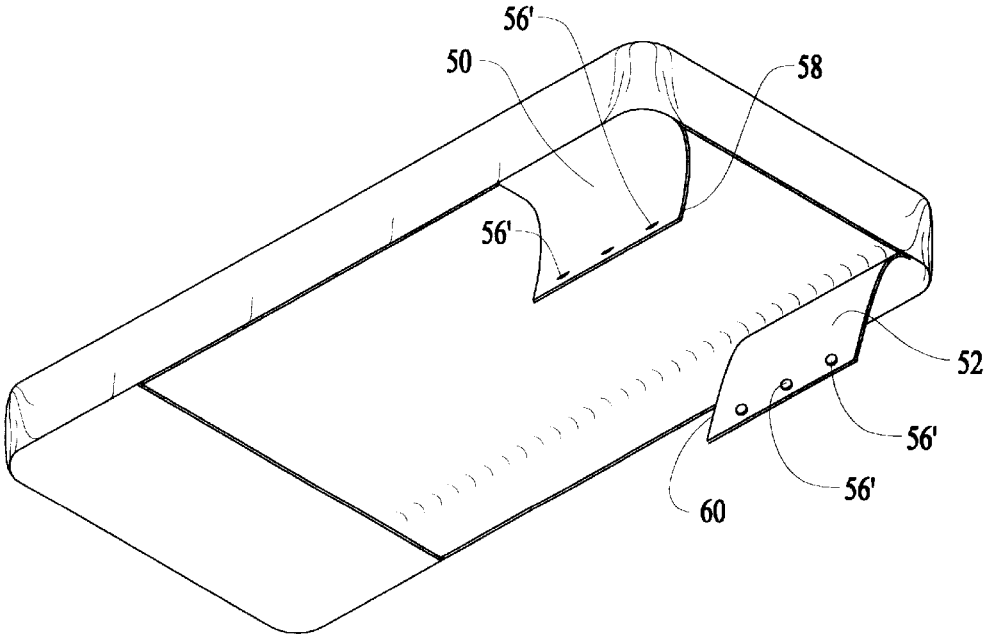
FIG. 3A is a bottom perspective view of the sheet construction shown in FIG. 1 having the second pouch flaps adapted with buttons for securement.
Figure 3:
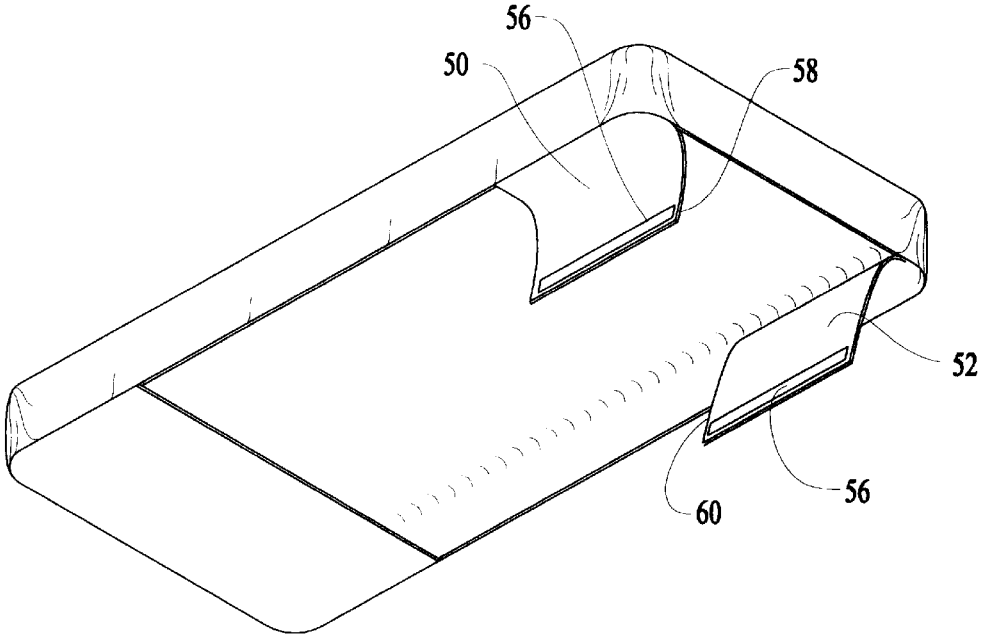
FIG. 3 is a bottom perspective view of the sheet construction shown in FIG. 1 having the second pouch flaps separated.
Figure 3B:
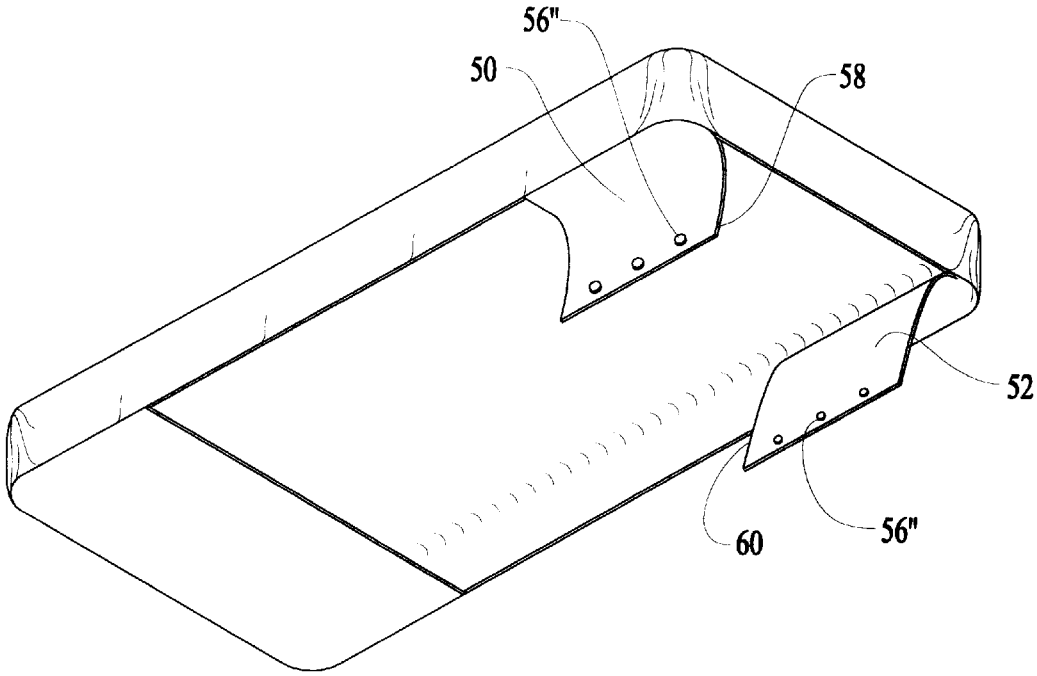
FIG. 3B is a bottom perspective view of the sheet construction shown in FIG. 1 having the second pouch adapted with snaps for securement.
Figure 3C:
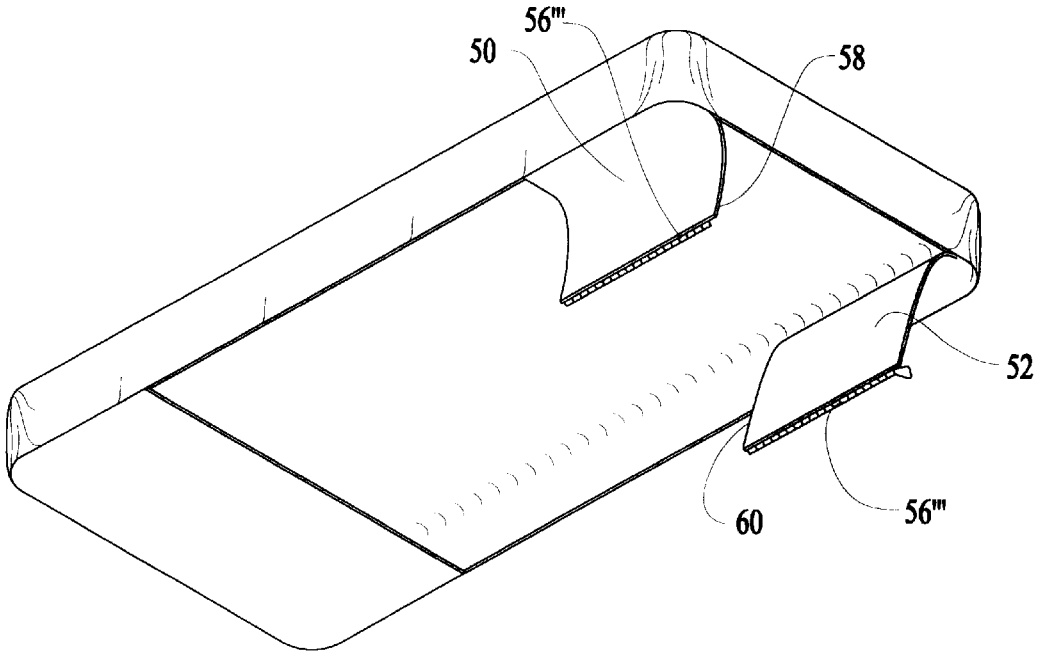
FIG. 3C is a bottom perspective view of the sheet construction shown in FIG. 1 having the second pouch flaps adapted with a zipper for securement.

As shown in FIG. 2, the flaps 22 and 24 and 50 and 52 overlap along a central securing seam 26 and 54. As shown in FIG. 3, releasable fastening material 56 is disposed along the overlapping portions 58 and 60 of the flaps 50 and 52. The fastening material 56 is preferably hook and loop type material, such as that available under the trademark VELCRO. Although hook and loop type material is preferred, other fasteners, such as buttons 56', snaps 56", or zippers 56''', may also secure the flaps, as shown in FIGS. 3A, 3B, and 3C.

Alternatively, the flaps 22 and 24 and/or 50 and 52 may be sized so as not to overlap. The sheet construction 10 may also be made with pouches 14 and 16 that are identical. That is, both pouches 14 and 16 may include a plurality of flaps 22 and 24 and 50 and 52 or both may be made with cooperating flaps.

During use, the first pouch 14 is slid onto the first end 38 of the mattress 36, and the flaps 50 and 52 are wrapped around the corners 62 and 64 of the mattress second end 40. Once the sheet construction 10 is in place, the second pouch 16 flaps 50 and 52 are overlapped and pressed together along the securing seam 54; the fastening 56 keeps the flaps in place. With this arrangement, the pouches 14 and 16 cooperate to encompass the mattress ends 38 and 40 securing the sheet construction 10 onto the mattress 36. These steps are reversed to remove the sheet construction 10.

Figure 4:
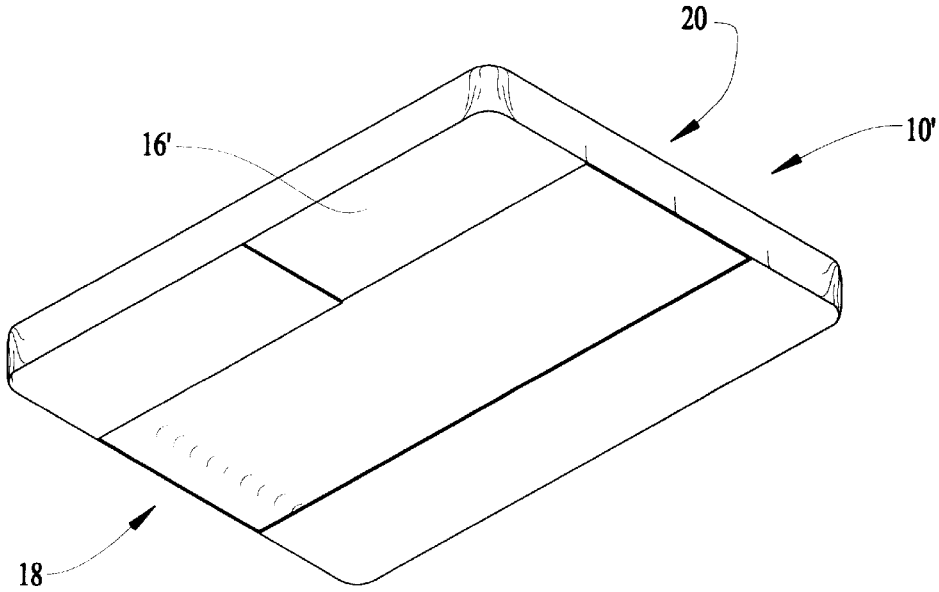
FIG. 4 is a pictorial view of an alternative embodiment of the sheet construction of the present invention, shown with pouches that engage the sides of a mattress.

Although the sheet construction has been described as having pouches 14 and 16 that encompass the mattress ends 38 and 40, other orientations are also possible. In an alternative embodiment, shown in FIG. 4, the position of the pouches 14' and 16' is rotated ninety degrees. In this embodiment 10', the pouches 14' and 16' are enlarged to fit the mattress first and second sides 42 and 44 respectively. The sheet construction second embodiment 10' is applied and removed in a manner similar to the first embodiment, except that the pouches 14' and 16' engage the mattress sides 42 and 44. This arrangement makes the sheet construction 10' easier to use on some mattresses.

Although the invention has been described in terms of a specific embodiment, it will be readily apparent to those skilled in this art that various modifications, rearrangements, and substitutions can be made without departing from the spirit of the invention. The scope of the invention is defined by the claims appended hereto.

What is claimed is:

1. A sheet construction adapted to fittingly engage a mattress, said sheet construction comprising:

a main panel having a first end and a second end;

a first pouch disposed at said main panel first end, said first pouch adapted to encompass a first end of a mattress;

a second pouch disposed at said main panel second end, said second pouch adapted to encompass a second end of a mattress;

herein said first pouch and second pouch are characterized by a plurality of cooperating flaps extending from said main panel;

whereby said first pouch and said second pouch cooperate to secure said main panel to a mattress.

2. The sheet construction of claim 1, wherein each of said flaps includes a fastener, whereby adjacent flaps are releasably linked together.

3. The sheet construction of claim 1 wherein each of said flaps of said first pouch includes a fastener, whereby adjacent flaps of said first pouch are releasably linked together.

4. A sheet construction adapted to fittingly engage a mattress, said sheet construction comprising:

a main panel having a first end and a second end;

a first pouch disposed at said main panel first end, said first pouch adapted to encompass a first end of a mattress;

a second pouch disposed at said main panel second end, said second pouch adapted to encompass a second end of a mattress;

wherein said second pouch is characterized by a plurality of cooperating flaps extending from said main panel;

hereby said first pouch and said second pouch cooperate to secure said main panel to a mattress.

5. The sheet construction of claim 4 wherein each of said flaps includes a fastener, whereby adjacent flaps are releasably linked together.

* * * * *